US006525640B1

(12) United States Patent
Busnello

(10) Patent No.: US 6,525,640 B1
(45) Date of Patent: Feb. 25, 2003

(54) RESISTIVE THERMOSTAT FOR ELECTRICAL MOTORS PROTECTION

(75) Inventor: Homero Cremm Busnello, Sao Paulo (BR)

(73) Assignee: Tecumseh do Brasil LTDA., Sao Paulo (BR)

( * ) Notice: Subject to any disclaimer, the term of this patent is extended or adjusted under 35 U.S.C. 154(b) by 41 days.

(21) Appl. No.: 09/596,718

(22) Filed: Jun. 19, 2000

(51) Int. Cl.[7] ..... H01H 71/16; H01H 71/02

(52) U.S. Cl. ..... 337/85; 337/77; 337/97; 337/112

(58) Field of Search ..... 337/77, 85, 89, 337/97, 100–107, 112, 333, 342, 343, 377, 379, 380, 349, 56, 389–391, 417; 29/622

(56) References Cited

U.S. PATENT DOCUMENTS

| | | | | | |
|---|---|---|---|---|---|
| 3,223,808 | A | * | 12/1965 | Wehl | 200/138 |
| 3,622,930 | A | * | 11/1971 | D'Entremont | 337/107 |
| 4,136,323 | A | * | 1/1979 | D'Entremont et al. | 337/107 |
| 4,399,423 | A | * | 8/1983 | Nield | 337/102 |
| 4,476,452 | A | * | 10/1984 | D'Entremont | 337/102 |
| 4,490,704 | A | * | 12/1984 | Snider et al. | 337/372 |
| 4,646,195 | A | * | 2/1987 | Lisauskas | 361/25 |
| 5,804,798 | A | * | 9/1998 | Takeda | 219/511 |
| 5,808,539 | A | * | 9/1998 | White | 337/379 |
| 6,097,275 | A | * | 8/2000 | Kudoh | 337/377 |
| 6,127,913 | A | * | 10/2000 | Niino et al. | 337/343 |

FOREIGN PATENT DOCUMENTS

| | | | | |
|---|---|---|---|---|
| JP | 6-84438 | * | 3/1994 | 337/365 |

* cited by examiner

*Primary Examiner*—Anatoly Vortman
(74) *Attorney, Agent, or Firm*—Perman & Green, LLP

(57) ABSTRACT

A resistive thermostat for Motors protection against electrical overcurrents and overtemperature, having a rectangular prismatic body, with a front side cover, and a back side face being provided with a corner lowering having a spherical sector shape, as well as a pair of thin rectangular windows, the rectangular body forming an enlargement of its front edge for fitting of the cover, from which a lower tab is appended, having a locating end cutout with reference to two pins of a three-pins connection plug; and further; inside the prismatic box, corresponding to the pair of thin side windows, it is provided an end pair of metallic supports for an electrical resistor, wherein one of such support projects a balanced metallic blade outside the box, including one of its connection terminals, while in the other inner support having a C shaped attached to the end of the balanced bimetallic blade, immediately subjacent and connected in series with the electrical resistor and with the lower opposite and free end of the balanced metallic blade having a movable contact button facing a fixed button, the fixed button being mutual with a binding or inlet terminal, aligned with a corresponding orifice provided on the surface of the front side cover, and receiving a third pin of a protector three-pins coupling plug from the motor.

3 Claims, 3 Drawing Sheets

RESISTIVE THERMOSTAT FOR ELECTRICAL MOTORS PROTECTION

BACKGROUND OF THE INVENTION

1. Field of the Invention

The present invention relates to electrical motor protection apparatus, and more particularly to a resistive thermostat for electrical motor protection.

From the essential point of view, such protectors comprise a thermostat metallic device, with the corresponding pair of electrical contacts, and thermally coupled with the motor it intends to protect, and also an electrical resistor heater connected in series to the motor in order to heat the first, the assembly actuating so that, in case of any motor overheating, the combined heating effect of the thermal coupling with the motor and the electrical resistor heating system is such that results in the heating of the thermostat metallic device, being enough to configurationally deform it and separate the protector electrical contacts, thus interrupting the electric power feeding to the motor.

Concerning the real conceptive simplicity of such protectors, their currently existing constructive embodiments are extremely complex and expensive, including the unit external structure or body with multiple and varied cutouts, depressions, prominences and the like, such fact being also observed in the essential components themselves, also comprising a plurality of parts, further affected by several details of tabs, hotels, pins and the like, all such constructive complexity being naturally responsible for the major difficulties of its accomplishment and assembly, as well as increasing its cost, and further favoring the existence of disarrangements, lockings and other irregularities.

BRIEF SUMMARY OF THE INVENTION

An object of the invention is to provide an improved protection for high currents and temperatures in electrical motors using a resistive thermostat apparatus.

DETAILED DESCRIPTION OF THE INVENTION

Figure 2:
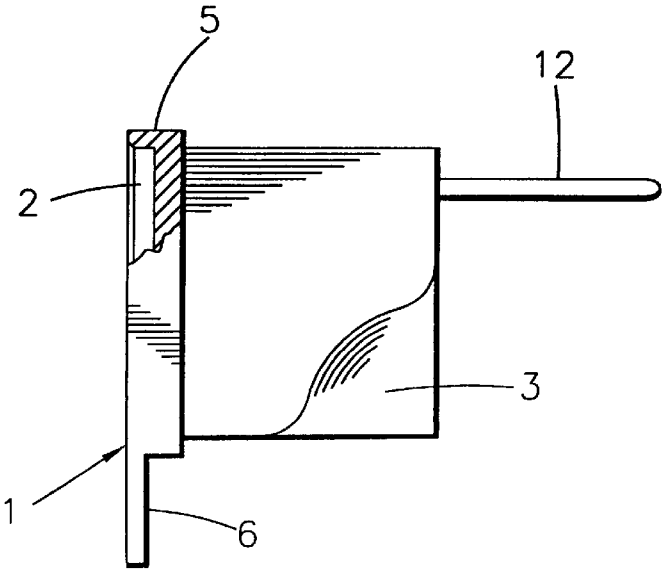
FIG. 2 is a side and partially sectioned view of the same resistive thermostat of FIG. 1.
Figure 1:
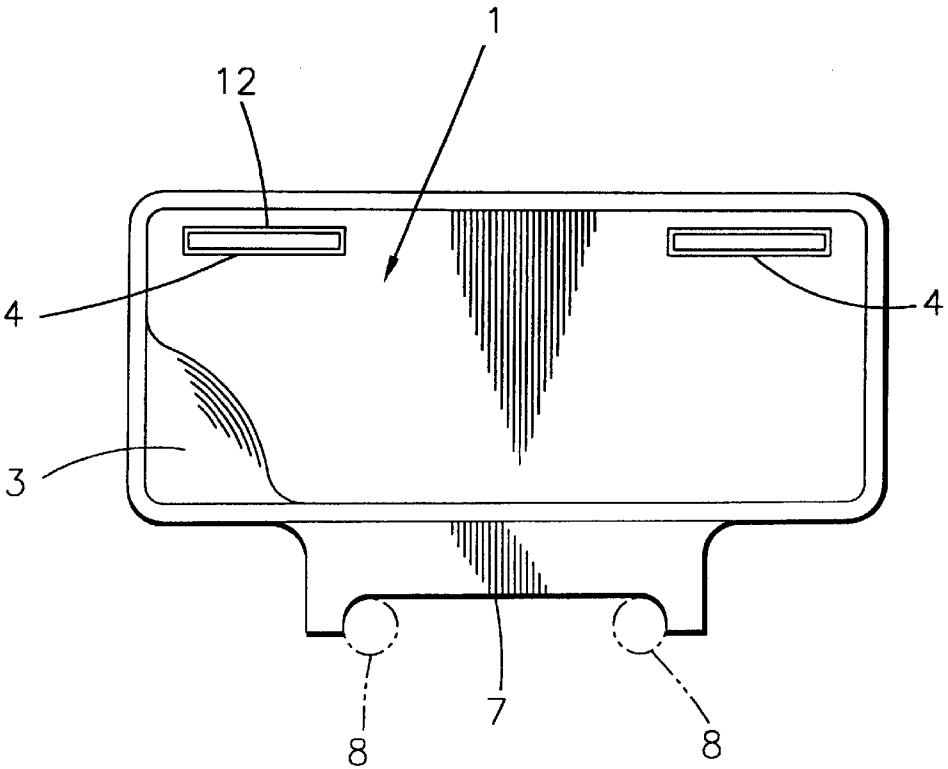
FIG. 1 is a front view of the concerned resistive thermostat for motors protection.

Referring to FIGS. 1 through 6, a resistive thermostat for motor protection against electrical overcurrents and overtemperature is shown comprising a rectangular prismatic body or box 1, with a front side cover 2, both made of thermal and electrical insulating material (FIGS. 1 and 2), such body having the back side face (disposed opposite to cover 2) provided with a corner lowering 3 having a spherical sector shape, for supporting a user's finger when handling it to apply and remove it from the external surface of the engine (not shown), the box being also provided with a pair of thin rectangular windows 4, being longitudinally aligned and proximately to its upper edge.

Further, said prismatic box 1, constituting the unit body, forms an enlargement of the front edge 5 (FIGS. 2 and 4) for a stable fitting of cover 2, from which a lower tab 6 is appended, having a locating en cutout 7 (FIG. 1) with reference to two pins 8 of the three-pins connection plug which projects from the engine body.

Advancing, and inside the prismatic body 1 of the concerned device (FIGS. 3 and 4), also corresponding to the aligned pair of thin windows 4 of its back side face, it is provided an end pair of metallic supports 9 and 10 for the electrical resistor 11, being dully positioned, wherein one of such supports 9 projects a balanced metallic blade 12 outside the box, comprising one of its connection terminals.

In turn, the other inner support 10 for the electrical resistor 11, intentionally having a C shape, attaches one of the ends of a balanced bimetallic blade 13, arranged in immediate subjacency and connected in series with the electrical resistor 11 (FIG. 3), and naturally with the lower opposite and free end having a contact button (movable) 14, facing another fixed button 15, the latter being mutual, by a connection metallic plate 16, with the binding or inlet terminal 17 being aligned with a corresponding orifice 18 provided on the cover surface 2, and receiving the third pin of the protector three-pins coupling plug concerned in the motor it is intended to.

Figure 3:
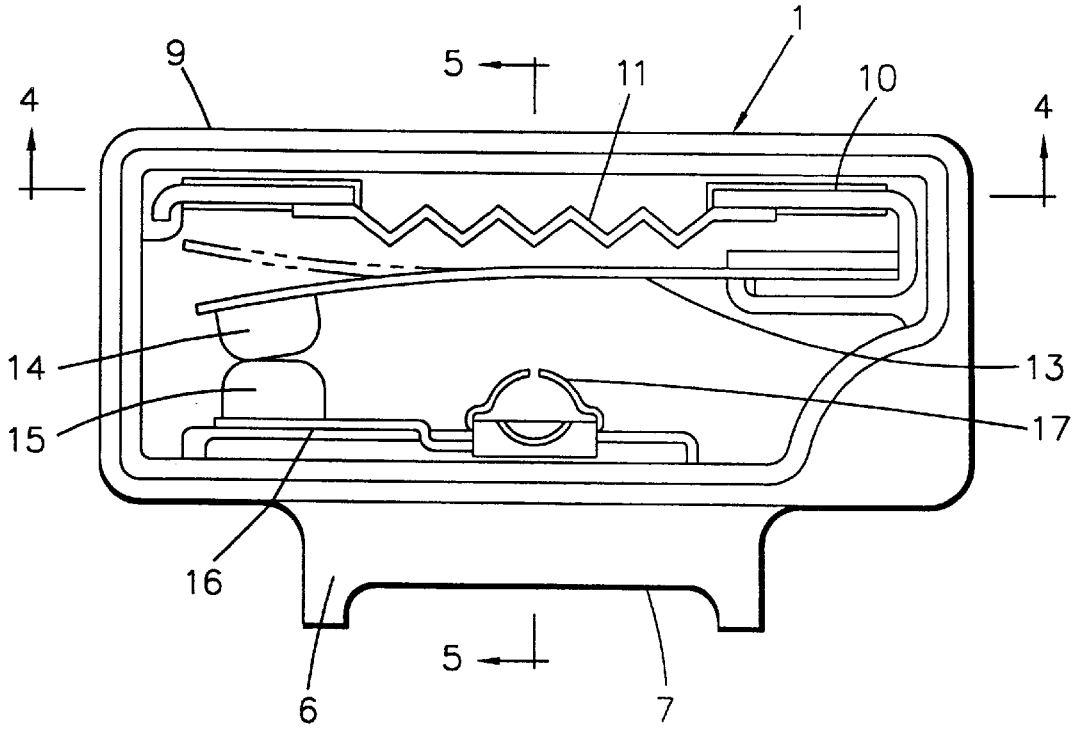
FIG. 3 is an internal and front view of said resistive thermostat.
Figure 4:
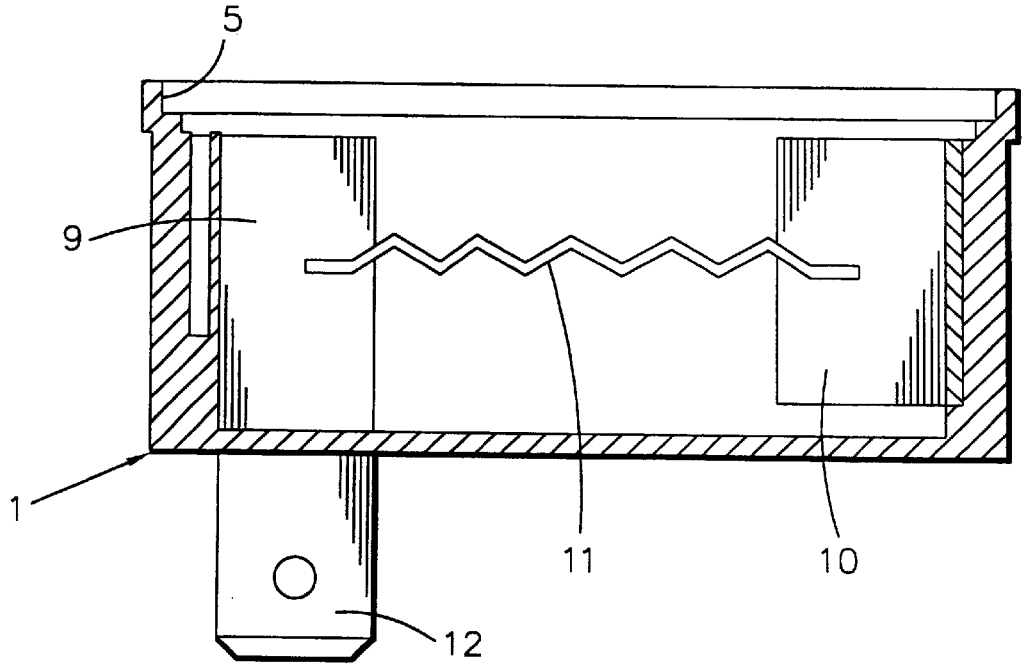
FIG. 4 is a longitudinal section view as per A—A, indicated in FIG. 3.
Figure 5:
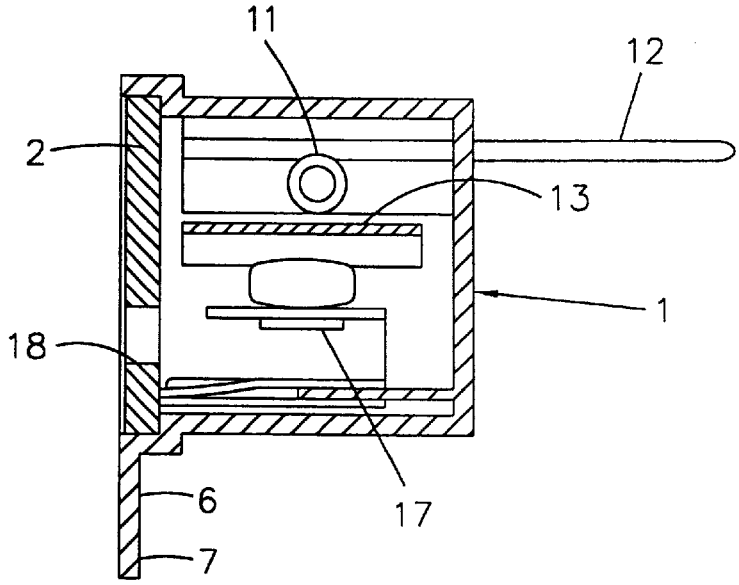
FIG. 5 is a cross-section view as per B—B, also indicated in FIG. 3.
Figure 6:
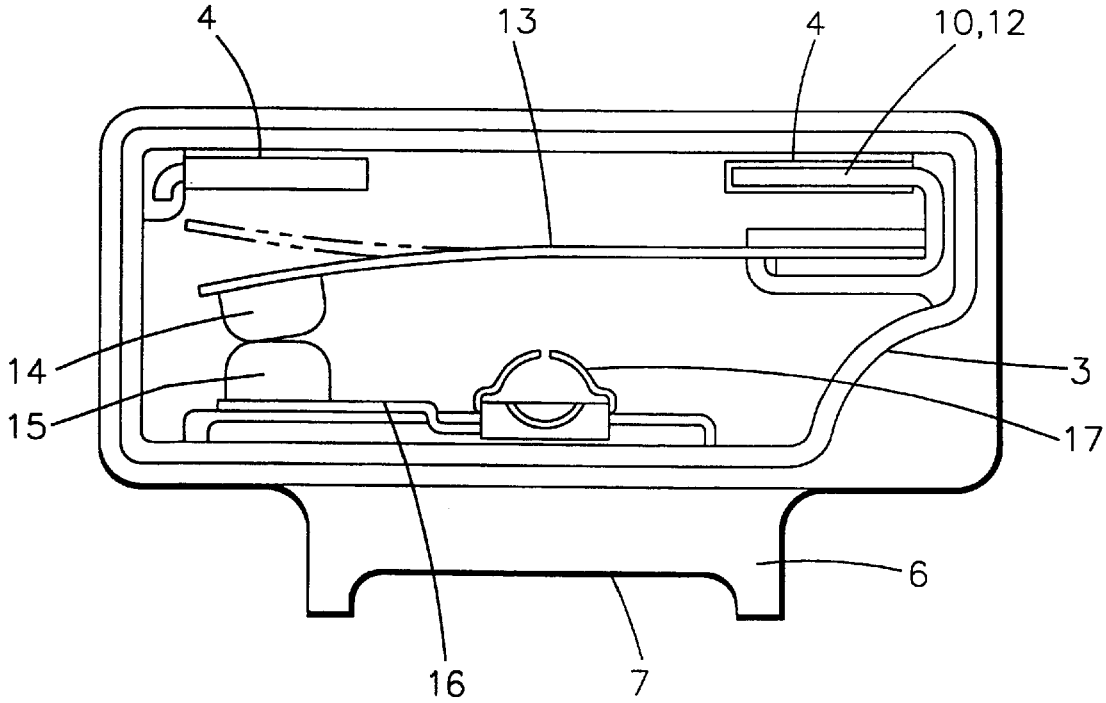
FIG. 6 is an internal and front view of another embodiment of the concerned resistive thermostat.

The operation of the protection resistive thermostat is virtually identical to other known protectors, that is, while the motor does not overheat due to eventual overcurrents or equivalents, it remains as illustrated (shown in full line) in FIG. 3, that is, with the movable contact 14 and the fixed contact 15 closed, thus keeping the power feeding circuit for the motor.

Continuing, in any eventual case wherein said motor overheating takes place, the thermal and electrical coupling heating effect, combined with the motor, by means of the electrical resistor 11 and the bimetallic blade 13, determines a naturally progressive heating of this latter, until its resulting configurative deformation (shown in dotted line in FIG. 3), due to its balanced assembly, pushes away the movable contact 14 from the fixed contact 15, opening the power feeding circuit for the motor and thus stopping its operation.

It is important to note that the resistive thermostat, as described above, may be used in any condition of the motor, however, it is particularly useful for those working with a low current that would not be enough to deform the bimetallic blade 13, such case justifying the contribution of the electrical resistor 11, connected in series therewith.

In cases where the motor works with a high electric current that is enough to deform the bimetallic blade 13, it is possible to dispense with the electrical resistor (FIG. 6) and, in such case, the balanced metallic blade 12, consisting in one of the connection terminals of the protector, is derived and projected outside the C-shaped support 10 (to which the end of the bimetallic blade 13 is attached).

As discussed above, it is evident the extreme simplicity of the described resistive thermostat, relating to both its reduced number of component parts and their simplified configuration, being all aimed to reach the excellent working regularity, perfection and efficiency, as well as great facilities for its accomplishment, assembly and maintenance, further including an advantageous economic aspect and the total impossibility of disarrangement and other shortcomings.

What is claimed is:

1. A resistive thermostat for electrical motors protection against electrical overcurrents and overtemperature, comprising a three-pins connection plug that projects from an electrical motors body, a rectangular prismatic body (1), with a front side cover (2), said rectangular prismatic body having a back side face, opposite to said front side cover (2), and provided with a corner lowering (3) having a spherical sector shape, for supporting a user's finger when handling, said front side cover being also provided with a pair of thin rectangular windows (4) longitudinally aligned and proximately to the upper edge at said front side cover, said rectangular prismatic box (1) forming an enlargement of the front edge of said front side cover (5) for a stable fitting of said cover (2), from which a lower tab (6) is appended, said lower tab having a locating end cutout (7) dimensioned with reference to two pins (8) of said three-pins connection plug which projects from an Electrical Motors body.

2. A resistive thermostat for electrical motors protection as claimed in claim 1, including an electrical resistor, and a balanced bimetallic blade wherein inside the prismatic box or body (1), also corresponding to said aligned pair of thin windows (4) of said back side face, said prismatic box is provided with an end pair of metallic supports (9) and (10) for said electrical resistor (11) so positioned, wherein one of said pair of metallic supports (9) projects a balanced metallic blade (12) outside the box, comprising one of its connection terminals, while in the other inner support (10) having a C shape, there attaches one of the ends of said balanced bimetallic blade (13), said balanced bimetallic blade being arranged in immediate subjacency and connected in series with said electrical resistor (11), and naturally with a lower opposite and free end of said balanced bimetallic blade having a movable contact button (14), facing a fixed button (15), a metallic plate (16), a binding or inlet terminal, the fixed button being mutual, by said connection metallic plate (16), with said binding or inlet terminal (17) being aligned with a corresponding orifice (18) provided on the surface (2), of said front side cover and receiving a third pin of said three-pins connection plug.

3. A resistive thermostat for electrical motors protection as claimed in claim 1, further including a balanced bimetallic blade (13) and a balanced metallic blade (12) wherein one end of said balanced metallic blade (12) is projected outside the unit body (1), and wherein said rectangular prismatic box includes a C-shaped support (10) to which the end of the bimetallic blade (13) is attached.

* * * * *